United States Patent [19]

Evans

[11] 3,996,073

[45] Dec. 7, 1976

[54] INSULATIVE COATING FOR ELECTRICAL STEELS

[75] Inventor: James D. Evans, Middletown, Ohio

[73] Assignee: Armco Steel Corporation, Middletown, Ohio

[22] Filed: Nov. 5, 1975

[21] Appl. No.: 629,060

Related U.S. Application Data

[62] Division of Ser. No. 513,951, Oct. 11, 1974, Pat. No. 3,948,786.

[52] U.S. Cl. ..... 148/6.15 R; 148/6.16; 148/113; 252/63.5; 106/286; 148/31.5

[51] Int. Cl.[2] ..... C23F 7/10

[58] Field of Search ..... 148/6.15 R, 113, 122, 148/6.16, 31.5, 31.55; 252/63.5; 106/286

[56] References Cited

UNITED STATES PATENTS

| | | | |
|---|---|---|---|
| 2,501,846 | 3/1950 | Gifford | 148/6.15 R |
| 2,554,250 | 5/1951 | Horstman | 148/6.15 R |
| 2,743,203 | 4/1956 | Steinherz | 148/6.15 R |
| 3,138,492 | 6/1964 | Perry | 148/6.15 R |
| 3,144,364 | 8/1964 | Robinson et al. | 148/113 |
| 3,207,636 | 9/1965 | Wada | 148/22 |
| 3,248,249 | 4/1966 | Collins Jr. | 148/6.16 |
| 3,248,250 | 4/1966 | Collins Jr. | 106/286 |
| 3,248,251 | 4/1966 | Allen | 427/380 |
| 3,528,863 | 9/1970 | Foster et al. | 148/113 |
| 3,720,549 | 3/1973 | Hirst et al. | 148/113 |
| 3,840,378 | 10/1974 | Evans | 148/6.15 R |
| 3,948,786 | 4/1976 | Evans | 252/63.5 |

*Primary Examiner*—Ralph S. Kendall

*Attorney, Agent, or Firm*—Melville, Strasser, Foster & Hoffman

[57] ABSTRACT

Insulative coatings for electrical steels and methods of making them. The coatings are hard, glassy and smooth in nature, are easily cured and improve the magnetic characteristics of the electrical steels. The coatings are produced by applying to an electrical steel an aluminum-magnesium-phosphate solution containing $Al^{+++}$, $Mg^{++}$ and $H_2PO_4^-$ in a specified relative relationship and from 0 to 60% by weight colloidal silica on a water-free basis. The solutions contain at least 45% by weight water. Chromic anhydride ($CrO_3$) may be added to the coating solutions to improve wettability of the solutions, moisture resistance of the resulting coatings and interlaminar resistivity after stress relief anneal. An electrical steel coated with a solution of the present invention is thereafter subjected to a heat treatment to cure the insulative coating thereon.

6 Claims, 2 Drawing Figures

INSULATIVE COATING FOR ELECTRICAL STEELS

REFERENCE TO RELATED APPLICATION

This is a division of the copending application Ser. No. 513,951, filed Oct. 11, 1974, in the name of the same inventor and entitled INSULATIVE COATING FOR ELECTRICAL STEELS now U.S. Pat. No. 3,948,786.

BACKGROUND OF THE INVENTION

1. Field of the Invention

The invention relates to improved insulative coatings for electrical steels, and more particularly to insulative coatings characterized by a hard, smooth, glassy nature, improved moisture resistance, excellent space factor characteristics and which improve the magnetic characteristics of the electrical steels to which they are applied.

2. Description of the Prior Art

As used herein and in the claims the terms "electrical steel" and "silicon steel" relate to an alloy, the typical composition of which by weight percent falls within the following:

| | |
|---|---|
| Carbon | 0.060% maximum |
| Silicon | 4% maximum |
| Sulfur or Selenium | 0.03% maximum |
| Manangese | 0.02%-0.4% |
| Aluminum | 0.4% maximum |
| Iron | Balance |

While the insulative coatings of the present invention are applicable to carbon steels for electrical uses, non-oriented silicon steels and silicon steels having various orientations, they will, for purposes of an exemplary showing, be described with respect to their application to cube-on-edge oriented silicon steel. Such silicon steel is well known in the art and is characterized by the fact that the body-centered cubes making up the grains or crystals are oriented in a position designated (110)[001] in accordance with Miller's indices. Cube-on-edge oriented sheet gauge silicon steel has many uses, an exemplary one of which is the manufacture of laminated magnetic cores for power transformers and the like. In such an application, the magnetic characteristics of the cube-on-edge oriented silicon steel are important, and primary among these are core loss, interlamination resistivity, space factor and magnetostriction.

Prior art workers have recognized that the magnetic characteristics of cube-on-edge oriented silicon steel, and particularly those mentioned above, are enhanced if the silicon steel is provided with a surface film or glass. In the commercial manufacture of cube-on-edge oriented silicon steel an annealing separator is used during the final anneal to which the silicon steel is subjected (i.e. that anneal during which the cube-on-edge orientation is achieved). When an appropriate annealing separator is used, as for example magnesia or magnesia-containing annealing separators, a glass film is formed upon the surfaces of the silicon steel. This glass or film is generally referred to in the industry as a "mill glass". Heretofore, much work has been done toward the improvement of mill glass, as is exemplified in U.S. Pat. No. 2,385,332 and 3,615,918.

In some applications it is desirable to have an applied insulative coating rather than, or in addition to, the mill glass formed during the high temperature, orientation-determining anneal. This has led to the development of phosphate coatings such as those taught in U.S. Pat. No. 2,501,846; 2,492,095 and the copending application in the name of the present inventor, Ser. No. 237,344, filed Mar. 23, 1972 and entitled INSULATIVE COATINGS FOR ELECTRIC STEELS.

Prior art workers have also devoted much attention to the improvement of applied insulative coatings. A number of magnesium phosphate based coatings and aluminum phosphate based coatings have been developed, as exemplified by U.S. Pat. No. 2,743,203; 3,151,000; 3,594,240 and 3,687,742.

U.S. Pat. No. 3,649,372 teaches a reagent for forming an applied insulative coating, the major component of which is mono-basic magnesium phosphate. The reagent also includes aluminum nitrate and/or aluminum hydroxide together with chromic anhydride.

Belgian Patent No. 789,262 teaches an applied insulative coating involving the use of mono-aluminum phosphate solution, colloidal silica solution and chromic acid or magnesium chromate. The coating of this reference is intended to exert tension on the silicon steel strip to improve various ones of its magnetic properties. U.S. Pat. No. 3,594,240 and 3,687,742, mentioned above, also teach the benefits of a tension-imparting film.

The present invention is directed to improved applied coatings which may be used in addition to or in lieu of a mill glass. The invention is based upon the discovery that excellent insulative and tension-imparting applied coatings can be produced from an aqueous solution containing appropriate relative concentrations of $Al^{+++}$, $Mg^{++}$ and $H_2PO_4^-$ as will be taught hereinafter. If the curing of the coatings is accomplished in a conventional roller hearth furnace for thermal flattening of the strip, colloidal silica may be added to the coating solutions to prevent adherence of the coatings to the furnace rolls. Chromic anhydride may also be added to the coating solutions in a specified amount to improve their wettability, to enhance the moisture resistance of the final coatings and to improve the interlaminar resistivity after stress relief annealing. Upon curing, a hard, glassy, smooth-surfaced, tension imparting film or glass is formed having excellent space factor characteristics and improving the magnetic characteristics of the silicon steel. The coatings of the present invention can be cured at a temperature lower than those required by the usual phosphate coatings.

SUMMARY

The present invention contemplates the provision of improved insulative, tension-imparting coatings for electrical steels with or without a mill glass base coating. The coatings of the present invention can be formed on electrical steels by applying thereto an aluminum-magnesium-phosphate solution containing an $Al^{+++}$, $Mg^{++}$ and $H_2PO_4^-$ concentration in the following relative relationship on a water-free basis:

| | |
|---|---|
| $Al^{+++}$ as $Al_2O_3$ | 3-11% by weight |
| $Mg^{++}$ as MgO | 3-15% by weight |
| $H_2PO_4^-$ as $H_3PO_4$ | 78-87% by weight |

The total weight percentage of these components must be 100 on a water-free basis.

A colloidal silica solution may be added to the aluminum-magnesium-phosphate solution. If the concentration of $Al^{+++}$, $Mg^{++}$ and $H_2PO_4^-$ (again calculated as $Al_2O_3$, MgO and $H_3PO_4$, respectively) comprises 100 parts by weight on a water-free basis, the colloidal silica will comprise from 0 to 150 parts by weight on a water-free basis. When colloidal silica is present the total weight percent of $Al^{+++}$ (as $Al_2O_3$), $Mg^{++}$ (as MgO), $H_2PO_4^-$ (as $H_3PO_4$) and $SiO_2$ must be 100 on a water-free basis. At least 45% by weight of the solution is water.

Chromic anhydride can be added to the solutions of both embodiments to improve solution wettability, moisture resistance of the final coatings and interlaminar resistivity after stress relief anneal.

The coating solutions of the present invention may be applied to silicon steels (with or without a mill glass base coating) in any suitable and conventional manner. The coated silicon steels will thereafter be subjected to a heat treatment to dry the solution and form the desired insulative film or coating thereon.

DESCRIPTION OF THE PREFERRED EMBODIMENTS

While the coatings of the present invention may be applied to carbon steels for electrical uses, non-oriented silicon steels, and silicon steels of various orientations, they are particularly suitable for use with silicon steels of the cube-on-edge variety. While not intended to be so limited, the coatings will be described in their application to cube-on-edge oriented silicon steel. Such silicon steel will normally have a mill glass formed thereon during the process of its manufacture and the coatings of the present invention may be applied over such mill glass, or they may be applied to the bare metal (the mill glass base coating having been removed).

The manufacture of cube-on-edge oriented silicon steel is, in itself, well known in the art and generally includes the basic steps of hot rolling to hot band, pickling, cold rolling to final gauge in one or more stages, decarburizing and subjecting the steel to a final high temperature anneal, in which secondary grain growth occurs producing the desired cube-on-edge orientation is achived.

If the coatings of the present invention are to be applied over a mill glass formed during the high temperature anneal of the silicon steel, it is only necessary to remove excess annealing separator from the steel surface by scrubbing, light pickling or the like. If it is preferred to apply the coatings of the present invention to the bare metal surface of the silicon steel, the mill glass formed during the high temperature anneal must be removed by hard pickling or other appropriate and well known procedures. Where no mill glass is desired, special annealing separators have been developed which produce a more easily removable mill glass, as exemplified by U.S. Pat. No. 3,375,144.

The coatings of the present invention are achieved by applying to an electrical steel an aqueous aluminum-magnesium-phosphate solution and subjecting the steel to a heat treatment to form the coatings thereon. The aqueous solution, in the absence of colloidal silica, must contain $Al^{+++}$, $Mg^{++}$ and $H_2PO_4^-$ in the following relative relationship on a water-free basis: from 3 to 115 by weight $Al^{+++}$ calculated as $Al_2O_3$, from 3 to 15% by weight $Mg^{++}$ calculated as MgO and from 78 to 87% by weight $H_2PO_4^-$ calculated as $H_3PO_4$, the total weight percent of these compounds being 100 on a water-free basis.

Figure 1:
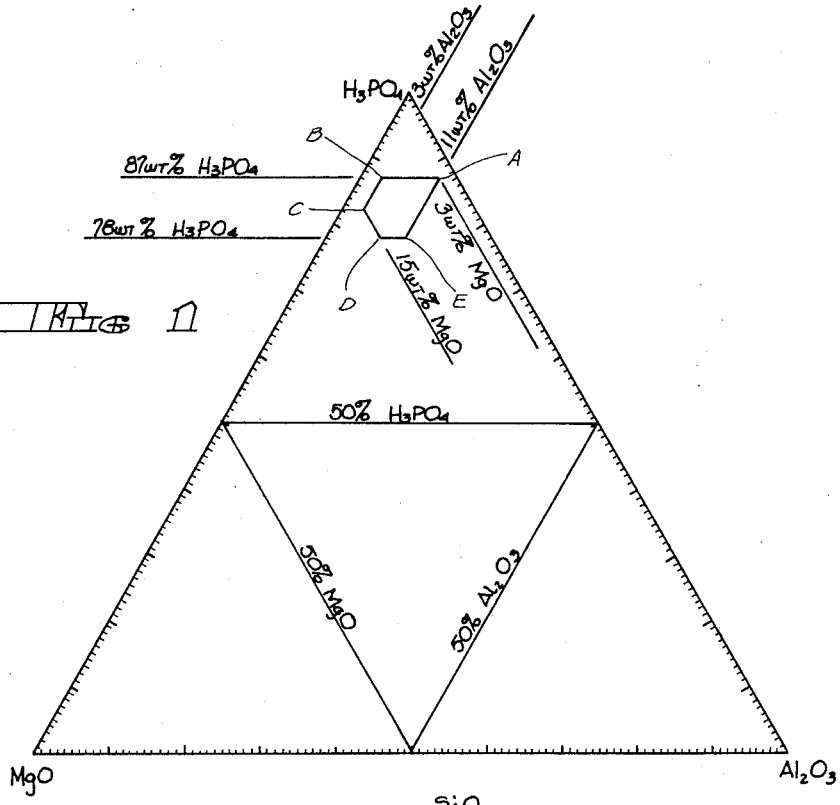
FIG. 1 is a two-dimensional graph illustrating on a water-free basis the relative relationship of $Al^{+++}$, $Mg^{++}$ and $H_2PO_4^-$ (calculated as $Al_2O_3$, MgO and $H_3PO_4$) in the coatings of the present invention in the absence of colloidal silica.

The above relationship of $Al^{+++}$ (as $Al_2O_3$), $Mg^{++}$ (as MgO) and $H_2PO_4^-$ (as $H_3PO_4$) is illustrated in the ternary diagram of FIG. 1. The graph of FIG. 1 is plotted on a water-free basis with the corners representing 100% by weight $Al_2O_3$, 100% by weight MgO and 100% by weight $H_3PO_4$, respectively.

It will be noted that the above stated ranges for $Al^{+++}$ (as $Al_2O_3$), $Mg^{++}$ (as MgO) and $H_2PO_4^-$ (as $H_3PO_4$), where the total weight present of these components is 100, bound an area A-B-C-D-E on the graph of FIG. 1. The coating solution may be made up having an $Al^{+++}$, $Mg^{++}$, $H_2PO_4^-$ relationship (on a water-free basis) represented by any point within the area A-B-C-D-E of FIG. 1. The $Al^{+++}$, $Mg^{++}$ and $H_2PO_4^-$ concentration may be achieved through the use of any appropriate combinations of compounds that will place these ions in solution (e.g. aluminum phosphates, aluminum hydroxide, magnesium phosphate, magnesia, magnesium hydroxide, phosphoric acid and the like).

When colloidal silica is present in the solution, a particular relationship between $Al^{+++}$, $Mg^{++}$, $H_2PO_4^-$ and colloidal silica ($SiO_2$) must be maintained on a water-free basis. On this basis, $Al^{+++}$, $Mg^{++}$ and $H_2PO_4^-$ are again calculated as $Al_2O_3$, MgO and $H_3PO_4$, respectively. The silica content may vary from 0 to 60% by weight of the $Al_2O_3$, MgO, $H_3PO_4$, $SiO_2$ system on a water-free basis. The addition of more than about 60% by weight $SiO_2$ may result in a solution having a tendency to gel.

As calculated on a water-free basis, the weight percents of $Al^{+++}$ (as $Al_2O_3$), $Mg^{++}$ (as MgO) and $H_2PO_4^-$ (as $H_3PO_4$) will depend upon the $SiO_2$ content by the following formulae:

$$\text{Weight percent } Al^{+++} \text{ (as } Al_2O_3) = [3 \text{ to } 11\%] \frac{100\% - \%SiO_2}{100\%}$$

$$\text{Weight percent } Mg^{++} \text{ (as MgO)} = [3 \text{ to } 15\%] \frac{100\% - \%SiO_2}{100\%}$$

$$\text{Weight percent } H_2PO_4^- \text{ (as } H_3PO_4) = [78 \text{ to } 87\%] \frac{100\% - \%SiO_2}{100\%}$$

where the total weight percent of $SiO_2$, $Al^{+++}$ (as $Al_2O_3$), $Mg^{++}$ (as MgO) and $H_2PO_4^-$ (as $H_3PO_4$) is equal to 100.

Figure 2:
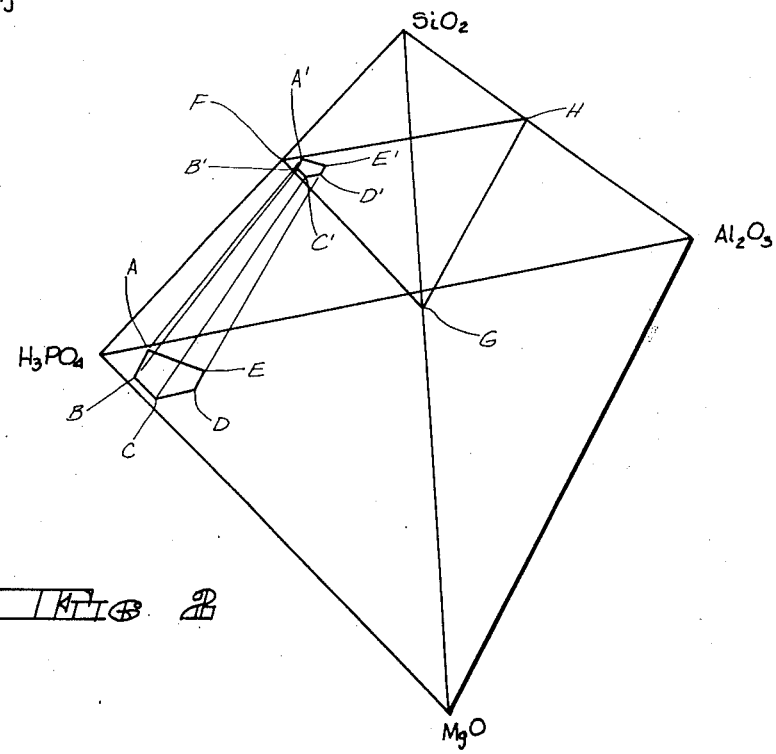
FIG. 2 is a three-dimensional graph illustrating on a water-free basis the relative relationship of $Al^{+++}$, (as $Al_2O_3$), $Mg^{++}$ (as MgO), $H_2PO_4^-$ (as $H_3PO_4$) and colloidal silica ($SiO_2$) in the coatings of the present invention.

The relationship (on a water free basis) between $Al^{+++}$ (as $Al_2O_3$), $Mg^{++}$ (as MgO), $H_2PO_4^-$ (as $H_3PO_4$) and $SiO_2$ is illustrated in the three-dimensional graph of FIG. 2. In this graph the four corners of the tetrahedron represent 100% by weight $Al_2O_3$, 100% by weight MgO, 100% by weight $H_3PO_4$ and 100% by weight $SiO_2$. The base of the graph is identical to FIG. 1 as is the area A-B-C-D-E. The 60% by weight level of $SiO_2$ is represented by the triangle generally indicated at F-G-H and lying parallel to the base of the tetrahedron. It will be noted that as the percent by weight of $SiO_2$ increases the original shape of area A-B-C-D-E remains the same but the area itself diminishes in size until it intersects the 60% by weight $SiO_2$ level (triangle F-G-H) in an area A'-B'-C'-D'-E'.

In accordance with the present invention, the coating solution may be made up with weight percents of $SiO_2$, $Al^{+++}$ (as $Al_2O_3$), $Mg^{++}$ (as MgO), and $H_2PO_4^-$ (as $H_3PO_4$) represented on a water-free basis by any point on any plane parallel to the base of the tetrahedron of FIG. 2 within the volume represented in that figure by A-B-C-D-E-A'-B'-C'-D'-E'.

The colloidal silica solution preferably comprises about 20 to 40% by weight colloidal silica, the balance being water. Colloidal silica solutions meeting this specification are commercially available. The composition of the colloidal silica solution may have a bearing on the shelf-life of the coating solution of the present invention. Excellent results have been achieved through the use of LUDOX TYPE AS, sold by E.I. Du Pont De Nemours & Co. Inc., Industrial Chemicals Department, Industrial Specialties Division, Wilmington, Delaware 19898. LUDOX is a registered trademark of E.I. Du Pont De Nemours & C., Inc. Excellent results have also been achieved through the use of NALCOAG-1034A, sold by Nalco Chemical Co., Chicago, Illinois. NALCOAG is a registered trademark of Nalco Chemical Co.

The coating solutions of the present invention may be applied to the cube-on-edge oriented silicon steel in any suitable manner including spraying, dipping or swabbing. Metering rollers and doctor means may also be used. When applied to the silicon steel over a mill glass, excess annealing separator from the final anneal of the silicon steel should be removed. When applied to the bare steel, the mill glass, itself, must be removed. In either instance, the surface of the steel to be coated should be free of oils, greases and scale.

The coating solutions may be as dilute as desired for controlled application to the surfaces of the electrical steel sheet or strip. It has been determined that, in the absence of colloidal silica, concentrated solutions containing less than about 45% of the total solution weight as water tend to produce rough coatings and are not easily applied by grooved wringer rolls. It has further been found that if colloidal silica is present in the coating solutions, concentrated solutions containing silica in an amount of more than 24% by weight of the total solution (i.e. solutions containing less than 60% of the total solution weight as water) tend to be unstable and gel.

The upper limit of the percentage of the total solution weight as water is dictated only by the desired coating weight and the coating method used and can be readily ascertained by one skilled in the art to meet his particular needs.

After coating, the silicon steel is subjected to a heat treatment to dry or cure the coating solution thereon to form the desired insulative coating. The drying or curing step may be performed at a temperature of from about 700° F to about 1600° F for from ½ to 3 minutes in an appropriate atmosphere such as air. It is also within the scope of the invention to perform the drying or curing step as a part of another heat treatment, such as a conventional flattening heat treatment.

While not required, chromic anhydride may be added to the coating solutions to improve the wettability of the solutions, to decrease the hygroscopic tendency of the final coatings and to improve the interlaminar resistivity after stress relief annealing. The chromic anhydride may be added in an amount of from about 10 to 25 parts by weight for every 100 parts by weight of $H_2PO_4^-$ calculated as $H_3PO_4$ in the solution.

When a coating of the present invention, having little or no colloidal silica, is cured in the mill in a conventional roller hearth furnace for thermal flattening of cube-on-edge oriented strip, the coating may stick to and accumulate on the furnace rolls during curing. Colloidal silica in the solution can prevent such sticking. The amount of colloidal silica will depend upon the particular type of furnace and the temperatures used for the curing of the coating. When the coating is cured as a part of a thermal flattening operation, it is preferred to use colloidal silica ($SiO_2$) in an amount of at least 25% by weight of the $Al^{+++}$ (as $Al_2O_3$), $Mg^{++}$ (as MgO), $H_2PO_4^-$ (as $H_3PO_4$) and $SiO_2$ system on a water-free basis. In other words if the concentration of $Al^{+++}$, $Mg^{++}$ and $H_2PO_4^-$, calculated as $Al_2O_3$, MgO and $H_3PO_4$ respectively, comprises 100 parts on a water-free basis it is preferred that colloidal silica ($SiO_2$) be present in an amount of at least 33 parts by weight on a water-free basis.

EXAMPLE 1

In-plant tests were run to compare the magnetic properties of commercial cube-on-edge oriented silicon steel having a mill glass and the same commercial cube-on-edge oriented silicon steel having a mill glass and coated with an insulative coating of the present invention. All coils used in this test were from the same heat and were processed into cube-on-edge oriented silicon steel with a mill glass by the same commercial routing.

From five of the mill glass coated coils, front and back samples were obtained and sheared into 10 Epstein samples. The samples were stress relief annealed at 1450° F for one hour in an atmosphere of 95% $N_2$ – 5% $H_2$ and then were tested for core loss and permeability at H=10 oersteds. Average resistivity was measured from the coils before stress relief annealing. Table I below gives the results of the testing, each value, except average resistivity, representing an average value for all of the Epstein samples from the front samples and an average value for all of the Epstein samples from the back samples. Average resistivity is the over-all average value from the five coils.

Four additional mill glass coated coils from the same heat were coated with a coating solution of the present invention, which solution contained 46.4% $SiO_2$, 45.3% $H_3PO_4$, 3.6% MgO and 4.7% $Al_2O_3$ on a water-free basis, and 64% water. In addition, $CrO_3$ was added in an amount of 25 grams of $CrO_3$ per 100 grams of $H_3PO_4$ in the above solution.

This solution was obtained by mixing: 55 gallons of a 50% mono-aluminum phosphate solution [containing 33.0% $P_2O_5$, 8.6% $Al_2O_3$ balance water and having a specific gravity at 70° F of 1.48]; 55 gallons of a magnesium phosphate solution [containing 27.4% $P_2O_5$, 6.9% MgO, balance water and having a specific gravity at 70° F of 1.43]; 55 gallons of water; 140 lbs. $CrO_3$; and 165 gallons colloidal $SiO_2$ (sold under the registered trademark NALCOAG-1034A)

The coated strip was subjected to a heat treatment of 1530° F for about forty seconds in an open flame-open air furnace to form the insulative coating of the present invention.

Front and back samples were taken from each coil and each front and back sample was sheared into an Epstein sample. The Epstein samples were tested for core loss, H=10 permeability, resistivity, space factor and magnetostriction. Thereafter the Epstein samples were stress relief annealed at 1450° F for one hour in a 95% $N_2$ – 5% $H_2$ atmosphere and then were retested. The values given for these samples in Table I represent average values for all of the Epstein samples from the front samples and average values of all of the Epstein samples from the back samples, except average resistivity which is the over-all average of the Epstein samples from both front and back samples In Table I, the term "AS CUT" refers in each instance to samples as coated, dried and sheared. The term "SRA" refers to the same samples after having been subjected to a stress relief anneal.

The data of Table I show that the average resistivity of the coating of the invention on mill glass is significantly greater than that of the mill glass coating above.

Epstein samples of examples 2–1 through 2–10 and examples 2–11 through 2–14 were stress relief annealed at 1450° F for four hours and 1500° F for two hours, respectively, in a dry 90° $N_2$ – 10% $H_2$ atmosphere and then were tested for core loss at 17 KGa, and Franklin resistivity at 300 psi. These test results are shown in Table II.

The examples of Table II indicate that the as cut Franklin resistivities of the coatings of the invention are significantly greater than that of the mill glass coating. In addition, examples 2–11 through 2–14 show that the addition of $CrO_3$ to coating solutions having high silica levels greatly increases the Franklin resistivity of the coating after stress relief annealing, as compared to the same coating after stress relief annealing, as compared to the same coating without $CrO_3$. Samples having a mill glass had less negative magnetostriction values than the coated samples indicating the effects of tension applied by the coatings.

TABLE II

| Example | COATING SOLUTION COMPOSITION ON DRY BASIS % $H_2PO_4$ | % MgO | % $Al_2O_3$ | % $SiO_2$ | % $H_2O$ | GMS $CrO_3$ PER 100GMS $H_3PO_4$ | FRANKLIN RESISTIVITY AMPS AS CUT | AMPS SRA | MAGNETIC PROPERTIES AFTER SRA CORE LOSS 17/60 | PERM. H=10 | 15KGa Δ1/L |
|---|---|---|---|---|---|---|---|---|---|---|---|
| 2–1 | 82.1 | 9.3 | 8.5 | 0 | 50 | 0 | .01 | .56 | .664 | 1920 | −52 |
| 2–2 | 83.3 | 12.1 | 4.6 | 0 | 53 | 0 | .00 | .80 | .678 | 1927 | −49 |
| 2–3 | 82.5 | 6.7 | 10.9 | 0 | 49 | 0 | .04 | .60 | .695 | 1901 | −53 |
| 2–4 | 83.3 | 8.0 | 8.6 | 0 | 50 | 0 | .01 | .72 | .655 | 1920 | −48 |
| 2–5 | 81.0 | 10.6 | 8.4 | 0 | 50 | 0 | | .51 | .670 | 1897 | −54 |
| 2–6 | 80.7 | 9.2 | 8.4 | 1.7 | 49 | 0 | | .60 | .639 | 1919 | −53 |
| 2–7 | 83.0 | 8.1 | 8.6 | 0 | 50 | 1 | | .54 | .658 | 1912 | −55 |
| 2–8 | 81.0 | 13.2 | 5.8 | 0 | 51 | 0 | | .50 | .679 | 1907 | −60 |
| 2–9 | 80.7 | 11.7 | 5.8 | 1.8 | 51 | 0 | | .61 | .651 | 1915 | −58 |
| 2–10 | 83.3 | 10.7 | 6.0 | 0 | 52 | 3 | | .60 | .675 | 1914 | −51 |
| 2–11 | 40.2 | 5.2 | 4.2 | 50.4 | 62 | 0 | .006 | .481 | .670 | 1924 | −62 |
| 2–12 | 40.2 | 5.2 | 4.2 | 50.4 | 62 | 24 | .021 | .119 | .674 | 1916 | −62 |
| 2–13 | 40.5 | 7.3 | 2.2 | 50.0 | 62 | 0 | .024 | .390 | .662 | 1922 | −53 |
| 2–14 | 40.5 | 7.3 | 2.2 | 50.0 | 62 | 24 | .011 | .065 | .684 | 1920 | −47 |
| 2–15 | Mill Glass Only | | | | | | .64 | .593 | .673 | 1920 | −44 |

TABLE I

| SAMPLE CONDITION | TEST POSITION | CORE LOSS 15Kg AS CUT | 15Kg SRA | 17Kg AS CUT | 17Kg SRA | PERM. AT H=10 | AVERAGE RESIST. (AMPS) AS CUT | SPACE FACTOR | MAGNETOSTRICTION AS CUT | MAGNETOSTRICTION SRA | EPSTEIN GAUGE |
|---|---|---|---|---|---|---|---|---|---|---|---|
| GLASS | F | — | .478 | — | .703 | 1838 | .534 | — | — | — | 10.2 |
| | B | — | .477 | — | .704 | | | | | | 10.4 |
| INVENTION COATING ON GLASS | F | .510 | .490 | .741 | .698 | 1829 | .173 | 97.1 | −115 | −153 | 10.7 |
| | B | .505 | .498 | .732 | .697 | | | | −100 | −135 | 10.6 |

EXAMPLE 2

Other tests were conducted in the laboratory using various coating compositions. Samples of high permeability grain oriented electrical steel were coated with the various solutions set forth in Table II. The coated strips were subjected to a heat treatment at 1530° F for 70 seconds in an electrically heated furnace having an air atmosphere to form the coatings of the invention.

The coated and cured samples of examples 2–1 through 2–10 were sheared into 8 strip Epstein samples and tested for Franklin resistivity at 300 psi. The coated and cured samples of examples 2–11 through 2–14 were sheared into two 8 strip Epstein samples and tested for Franklin resistivity at 300 psi. Thereafter, the The embodiments of the invention in which an exclusive property or privilege is claimed are defined as follows:

1. A process of providing an insulative coating directly on electrical steel and on electrical steel having a mill glass thereon comprising the steps of applying to said steel a coating solution containing an $Al^{+++}$, $Mg^{++}$ and $H_2PO_4^-$ concentration in the following relative relationship on a water-free basis: from 3 to 11% weight $Al^{+++}$ calculated as $Al_2O_3$, from 3 to 15% by weight $Mg^{++}$ calculated as MgO and from 78 to 87% by weight $H_2PO_4^-$ calculated as $H_3PO_4$, the total weight percentage of $Al^{+++}$ (as $Al_2O_3$), $Mg^{++}$ (as MgO) and $H_2PO_4^-$ (as $H_3PO_4$) being 100 on a water-free basis, said concentration of $Al^{+++}$, $Mg^{++}$ and $H_2PO_4^-$ comprising 100 parts by weight calculated as $Al_2O_3$, MgO and $H_3PO_4$ respectively on a water-free basis, and from 0 to 150 parts by weight of colloidal silica on a water-free basis, at least 45% by weight of said coating solution being water, and subjecting said coated steel to a heat treatment at a temperature of from about 700° to about 1600° F.

2. The process claimed in claim 1 including the step of adding to said solution from about 10 to about 25 parts by weight of chromic anhydride for every 100 parts by weight of $H_2PO_4^-$ calculated as $H_3PO_4$ in said solution.

3. A process of providing an insulative coating directly on electrical steel and on electrical steel having a mill glass thereon comprising the steps of applying to said steel a coating solution containing an $Al^{+++}$, $Mg^{++}$ and $H_2PO_4^-$ concentration in the following relationship on a water-free basis: from 3 to 11% by weight $Al^{+++}$ calculated as $Al_2O_3$, from 3 to 15% by weight $Mg^{++}$ calculated as MgO and from 78 to 87% by weight $H_2PO_4^-$ calculated as $H_3PO_4$, the total weight percentage of $Al^{+++}$ (as $Al_2O_3$), $Mg^{++}$ (as MgO) and $H_2PO_4^-$ (as $H_3PO_4$) being 100 on a water-free basis, said concentration of $Al^{+++}$, $Mg^{++}$ and $H_2PO_4^-$ comprising 100 parts by weight calculated as $Al_2O_3$, MgO and $H_3PO_4$ respectively on a water-free basis, and from 33 to 150 parts by weight of colloidal silica on a water-free basis, at least 60% by weight of said coating solution being water, and subjecting said coated steel to a heat treatment at a temperature of from about 700° to about 1600° F.

4. The process claimed in claim 3 including the step of adding to said solution from about 10 to about 25 parts by weight of chromic anhydride for every 100 parts by weight of $H_2PO_4^-$ calculated as $H_3PO_4$ in said solution.

5. An electrical steel having an insulative coating made by the process of claim 1.

6. An electrical steel having an insulative coating made by the process of claim 2.

* * * * *